US011008128B2

(12) United States Patent
Kuranda

(10) Patent No.: US 11,008,128 B2
(45) Date of Patent: May 18, 2021

(54) CUSTOMIZABLE WRAPPER

(71) Applicant: Allison L. Kuranda, Belvidere, IL (US)

(72) Inventor: Allison L. Kuranda, Belvidere, IL (US)

(73) Assignee: CONTINENTAL DATALABEL, INC., Elgin, IL (US)

( * ) Notice: Subject to any disclaimer, the term of this patent is extended or adjusted under 35 U.S.C. 154(b) by 1357 days.

(21) Appl. No.: 14/969,657

(22) Filed: Dec. 15, 2015

(65) Prior Publication Data

US 2016/0200472 A1 Jul. 14, 2016

Related U.S. Application Data

(63) Continuation of application No. 12/964,449, filed on Dec. 9, 2010, now abandoned, which is a continuation of application No. 11/585,789, filed on Oct. 24, 2006, now abandoned.

(51) Int. Cl.

| | |
|---|---|
| ***B65C 1/04*** | (2006.01) |
| ***B65C 9/00*** | (2006.01) |
| ***B65C 9/08*** | (2006.01) |
| ***B65D 65/14*** | (2006.01) |
| ***B65B 11/00*** | (2006.01) |
| ***B65B 11/48*** | (2006.01) |

(52) U.S. Cl.

CPC ..... *B65C 1/04* (2013.01); *B65B 11/00* (2013.01); *B65B 11/48* (2013.01); *B65C 9/0006* (2013.01); *B65C 9/0015* (2013.01); *B65C 9/08* (2013.01); *B65D 65/14* (2013.01)

(58) Field of Classification Search

CPC ..... B65C 1/07; B65C 9/0006; B65C 9/0015; B65B 11/00; B65B 11/1148; B65D 65/14

USPC ..... 53/411, 415

See application file for complete search history.

(56) References Cited

U.S. PATENT DOCUMENTS

| | | | | |
|---|---|---|---|---|
| 2,529,060 | A | 11/1950 | Trillich | |
| 2,676,897 | A | 4/1954 | Trillich | |
| 3,297,341 | A | 1/1967 | Reed et al. | |
| 4,700,976 | A * | 10/1987 | Loose | G09F 3/0288 156/204 |
| 4,863,191 | A | 9/1989 | Termanis | |
| 4,940,258 | A | 7/1990 | Cuba, Jr. et al. | |
| 5,306,372 | A | 4/1994 | Hall et al. | |
| 5,337,943 | A | 6/1994 | Hendren | |
| 5,800,893 | A | 9/1998 | Harden | |
| 5,893,512 | A | 4/1999 | Diedrich | |
| 5,979,651 | A | 11/1999 | Betts | |
| 6,090,027 | A * | 7/2000 | Brinkman | B65B 5/02 493/54 |

(Continued)

*Primary Examiner* — Sameh Tawfik

(74) *Attorney, Agent, or Firm* — Pauley Erickson & Swanson

(57) ABSTRACT

A customizable wrapper for a product, such as a candy bar, including a wrapper assembly having a pair of removable edges. A face sheet of the wrapper assembly includes a printable surface and an integrated wrapper sized to cover the product on both a front and back. A back sheet of the wrapper assembly includes a removable portion at least partially overlaying the wrapper, the removable portion removable to expose an adhesive surface along the wrapper. The customized wrapper is then wrapped around the product and adhered along the exposed adhesive.

20 Claims, 3 Drawing Sheets

(56) References Cited

U.S. PATENT DOCUMENTS

| | | | | |
|---|---|---|---|---|
| 6,096,397 | A | 8/2000 | Murphy | |
| 6,115,999 | A | 9/2000 | Adelman | |
| 6,213,518 | B1 * | 4/2001 | Raming | B42D 15/006 156/1 |
| 6,238,762 | B1 | 5/2001 | Friedland et al. | |
| 6,347,703 | B1 | 2/2002 | Betts | |
| 6,374,583 | B1 * | 4/2002 | Daelmans | B65D 65/14 53/483 |
| 6,495,228 | B1 | 12/2002 | Mauch et al. | |
| 6,594,927 | B2 * | 7/2003 | Witkowski | G09F 3/0288 40/306 |
| 6,699,541 | B2 | 3/2004 | Finestone et al. | |
| 6,730,396 | B2 | 5/2004 | Maloney | |
| 6,886,309 | B2 * | 5/2005 | Phillips | B65B 11/48 101/483 |
| 7,483,215 | B2 * | 1/2009 | Raymond | G02B 27/2214 359/627 |
| 7,641,951 | B2 * | 1/2010 | Hodsdon | G09F 7/12 345/501 |
| 2002/0093191 | A1 * | 7/2002 | Feng | B42D 15/08 283/116 |
| 2004/0118044 | A1 * | 6/2004 | Weder | A47G 7/085 47/72 |
| 2008/0093427 | A1 | 4/2008 | Kuranda | |
| 2008/0141568 | A1 | 6/2008 | Flynn | |
| 2009/0127322 | A1 * | 5/2009 | Miller | B65D 65/14 229/87.19 |
| 2010/0006464 | A1 | 1/2010 | Flynn | |
| 2010/0009828 | A1 | 1/2010 | Flynn | |
| 2011/0147255 | A1 | 6/2011 | Kuranda | |

* cited by examiner

CUSTOMIZABLE WRAPPER

CROSS REFERENCE TO RELATED APPLICATIONS

This application is a continuation of U.S. patent application, Ser. No. 12/964,449, filed on Dec. 9, 2009, which is a continuation of U.S. patent application, Ser. No. 11/585,789, filed on Oct. 24, 2006. The co-pending parent application is hereby incorporated by reference herein in its entirety and is made a part hereof, including but not limited to those portions which specifically appear hereinafter.

BACKGROUND OF THE INVENTION

Field of the Invention

This invention is directed to a customizable wrapper that includes a wrapper assembly with a label having a printable surface.

Description of Related Art

Weddings, parties, corporate events, trade shows and similar gatherings often require favors or giveaways. Typically, such giveaways are customized by the giver to suit the particular event. Several mail order companies exist that permit customization of candy bars and similar items by custom printing wrappers to replace the existing wrapper. Such wrappers are generally printed bands that are swapped in exchange for the original band.

As such, a need arises for a customizable wrapper that a gift or favor giver may design that is appropriate for the particular gift, event, occasion, season and/or recipient.

SUMMARY OF THE INVENTION

It is an object of the present invention to provide a customizable wrapper for a product, such as a candy bar.

The above and other objects of this invention can be attained with a wrapper assembly that includes a face sheet, a back sheet and a pair of removable edges. The face sheet preferably includes a printable surface, specifically along a wrapper portion of the face sheet, which is sized to cover a product, preferably on both a front and back, such as a candy bar.

According to a preferred embodiment of this invention, removable edges are removed to define a size of the wrapper. Such removable edges preferably permit standard sizing of the wrapper assembly and thus permit feeding the wrapper assembly within a typical consumer printer.

The back sheet of the wrapper assembly preferably includes a removable portion at least partially overlaying the wrapper that is removable to expose an adhesive surface along the wrapper. According to one preferred embodiment of this invention, the removable portion extends around a perimeter of wrapper, although additional configurations are contemplated by this invention.

According to one preferred embodiment of this invention, one or more lines of weakness may extend across the wrapper assembly to define two or more wrappers within the wrapper assembly.

A corresponding method of customizing the wrapper for a suitable product includes the step of feeding the wrapper assembly into a printer. The printable surface is next printed with customized information on the wrapper assembly, specifically on the wrapper. Following removal from the printer, the pair of removable edges are detached from the wrapper assembly and the removable portion of the back sheet is removed from the wrapper assembly. The removable portion thereby exposes an adhesive surface along at least a portion of the wrapper. The product may then be wrapped within the wrapper to cover a front and back of the product.

Other objects and advantages of this invention are apparent to those skilled in the art, in view of the following detailed description taken in conjunction with the appended claims and drawings.

BRIEF DESCRIPTION OF SEVERAL VIEWS OF THE DRAWINGS

The present invention can be better understood with reference to the following drawings. In the drawings, like reference numerals designate corresponding parts throughout the several views. The drawings are not necessarily to scale and emphasis is placed upon clearly illustrating principles of the present invention.

DETAILED DESCRIPTION OF PREFERRED EMBODIMENTS

Figure 1:
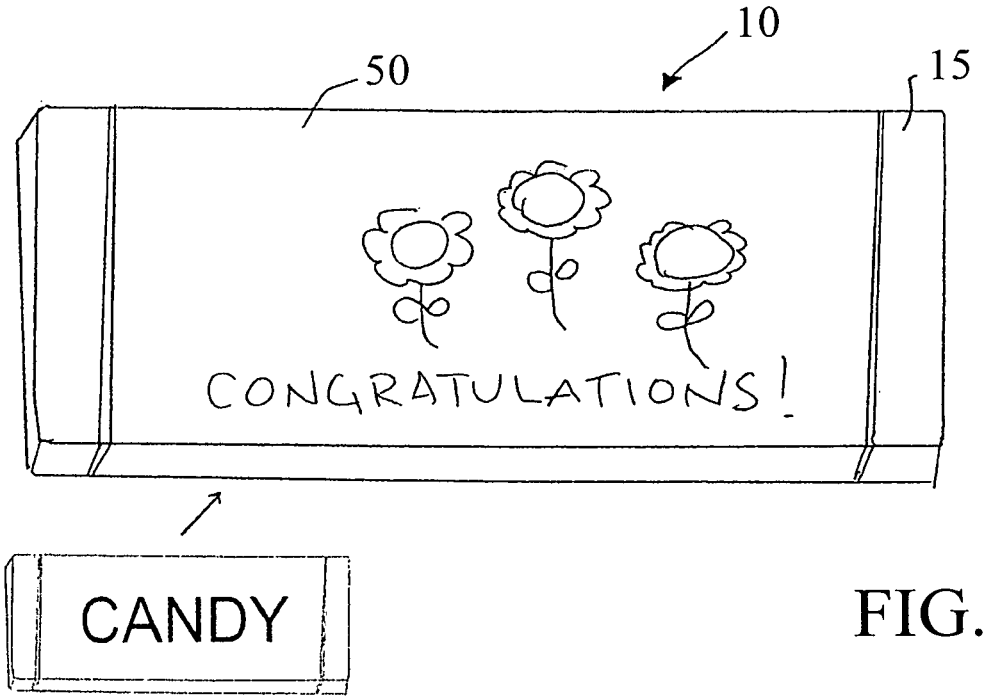
FIG. 1 is a perspective view of a customized wrapper in association with a candy bar according to one preferred embodiment of this invention.
Figure 2:
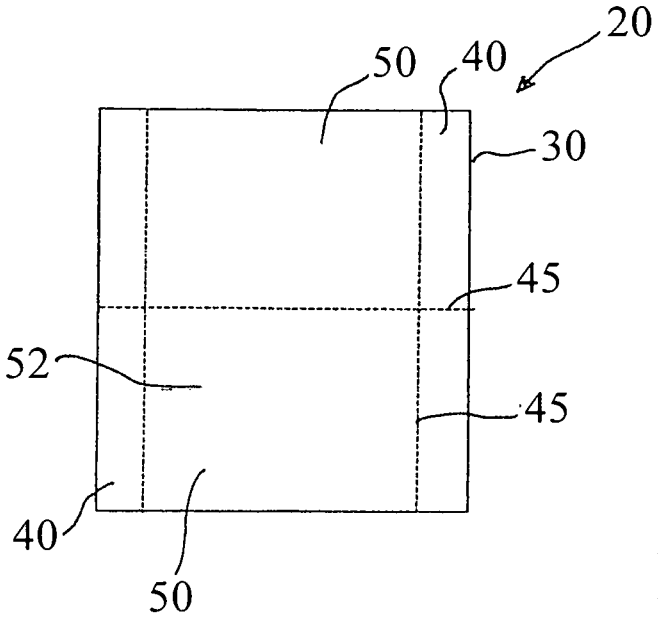
FIG. 2 is a plan view of a face sheet side of a wrapper assembly according to one preferred embodiment of this invention.
Figure 3:
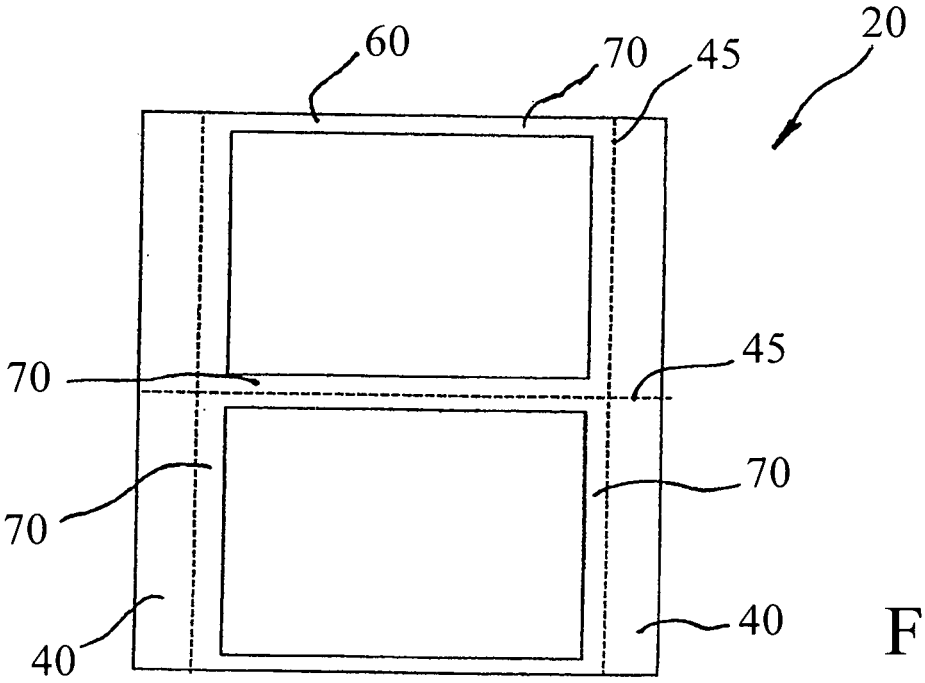
FIG. 3 is a plan view of a back sheet side of the wrapper assembly opposite a face sheet side shown in FIG. 2, according to one preferred embodiment of this invention.

The present invention is directed to a customizable wrapper for a wrapped product, such as shown in FIG. 1, including product 15 and wrapper assembly 20, such as shown in FIGS. 2 and 3. At least a portion of wrapper assembly 20 is preferably printable or otherwise customizable and then assembled with product 15 to result in a customized product 10.

Product 15 according to a preferred embodiment of this invention may include a candy bar or any other suitable product, edible or otherwise, that generally includes a wrapper or similar identifiable packaging.

Wrapper assembly 20 preferably includes a face sheet 30 and back sheet 60 removably adhered to face sheet 30. Face sheet 30 preferably includes at least one wrapper 50 that is removable from the back sheet 60 and separable from wrapper assembly. Label 50 preferably includes at least one printable surface 52 upon which information, decorations, personalization, etc. can be printed to customize wrapper 50 and, thus, product 15.

FIGS. 2 and 3 show each side of wrapper assembly 20 (not necessarily shown to scale) according to one embodiment of this invention. Wrapper assembly 20 is desirably formed of a face sheet 30, shown in FIG. 2, and an opposite back sheet 60, shown in FIG. 3. Back sheet 60 is desirably approximately the same size as face sheet 30, but may be larger or smaller than face sheet 30. A surface of face sheet 30 that is disposed toward back sheet 30 preferably includes an adhesive material coating. The adhesive coating can include any adhesive material known and available to those skilled in the art for forming pressure sensitive, or self-adhesive labels. Wrapper assembly 20 is preferably of any suitable shape, and generally any suitable size that can be accepted by and fed through a printer, such as a laser printer or an ink jet printer. Common sizes of paper generally fed through printers are 8.5 inches by 5.5 inches, 8.5 inches by 11 inches, 8.263 inches by 11.688 inches (A4 size), and 8.5 inches by 14 inches. Face sheet 30 is preferably, but not necessarily, constructed of any suitable paper, paper composite, non-metal and/or metal material that can be used as a label. Other suitable materials for constructing face sheet 30 include fabric, plastic, and metal foils. The adhesive coating covered by back sheet 60 is preferably applied to face sheet 30 in any suitable manner known to those skilled in the art. Face sheet 30 desirably has a printable surface 52 on a side opposite the adhesive coating.

Face sheet 30 and printable surface 52 can be any of a variety of face materials used to make pressure sensitive, or self-adhesive labels. Such face materials may include, but are not limited to: smudgeproof stock, litho stock, cast coated stock, tag stock, fluorescent stock, foils, computer printable polyester, vinyl, satin cloth, Tyvek™ material, flexible plastic, book papers, photo quality papers and/or photo quality film. Furthermore, various portions of the face materials can be different colors, thereby resulting in different colored parts.

The phrase "printable surface" relates to a surface of any type of matter upon which a person or machine can draw, print, color, paint, photocopy, write, emboss, or make any other type of mark or graphic. Laser printers, ink jet printers, impact printers, thermal transfer printers, direct thermal printers, typewriters, or any other suitable graphic printing devices are preferred but not necessary for use with printable surfaces according to this invention. Customization on wrapper 50 may include one or more images, patterns, print, pictures, drawings, letters, numbers, words and/or symbols, for example, to relate the gift giver, receiver and/or contents of product 15 to the customization.

As briefly described above, a layer of an adhesive is preferably positioned between back sheet 60 and face sheet 30 so that the adhesive adheres to face sheet 30 exclusively or at least adheres to face sheet 30 more than to back sheet 60 when back sheet 60 is removed from face sheet 30, as described hereafter. As a result of this configuration, wrapper assembly 20 preferably includes face sheet 30 having a printable side and an opposite, adhesive side and back sheet 60 including a separable side and an opposite side.

Face sheet 30 may include a plurality of shapes of wrappers 50, defined in face sheet 30 as one or more individual wrappers 50 according to this invention. The phrase wrapper 50, "shape," or the phrase "removable or tearable shape," are intended to relate to a shape, such as the shapes identified in FIG. 2 by element reference numeral 50, that can be removed or torn away from a remaining portion of wrapper assembly 50, such as by removing edges 40. Specifically, as described below in more detail, wrapper 50 is preferably dimensioned to wrap a particular product 15 depending on the size and shape of such product 15.

Tearable lines of weakness 45 can be formed as a perforation, cut or similar weakness in wrapper assembly 20 known to those skilled in the art, such as die-cut lines, perforated lines, micro-perforated lines, or any combination of these types of separation, or any other suitable structure that enables separation, specifically separation of edges 40 from wrapper assembly 20 and/or separation of multiple adjacent wrappers 50 from each other. A preferred type of line of weakness 45 is a perforation, such as shown in FIGS. 2 and 3. Wrapper 50 can be die-cut along at least a portion of a periphery, such that wrapper 50 can be easily removed or separated from face sheet 30, for example after wrapper assembly 20 is run through a printer and edge portions 40 of wrapper assembly 20 are removed as described below. In operation, wrapper assembly 20 includes face sheet 30 and a pair of removable edges 40. Face sheet 30 includes printable surface 52 as described, specifically along wrapper 50 which is sized to cover product 15, preferably on both a front and back.

According to a preferred embodiment of this invention shown in FIGS. 2 and 3, removable edges 40 are removed to define a size of wrapper 50. As such, a smaller wrapper 50 will include larger removable edges 40 and vice versa. Such removable edges 40 permit standard sizing of wrapper assembly 20 and thus cooperation of wrapper assembly 20 within a typical consumer printer.

Back sheet 60 of wrapper assembly 20 preferably includes removable portion 70 at least partially overlaying wrapper 50 and removable to expose an adhesive surface along wrapper 50. According to one preferred embodiment of this invention, shown in FIG. 3, removable portion 70 extends around a perimeter of wrapper 50.

Figure 4:
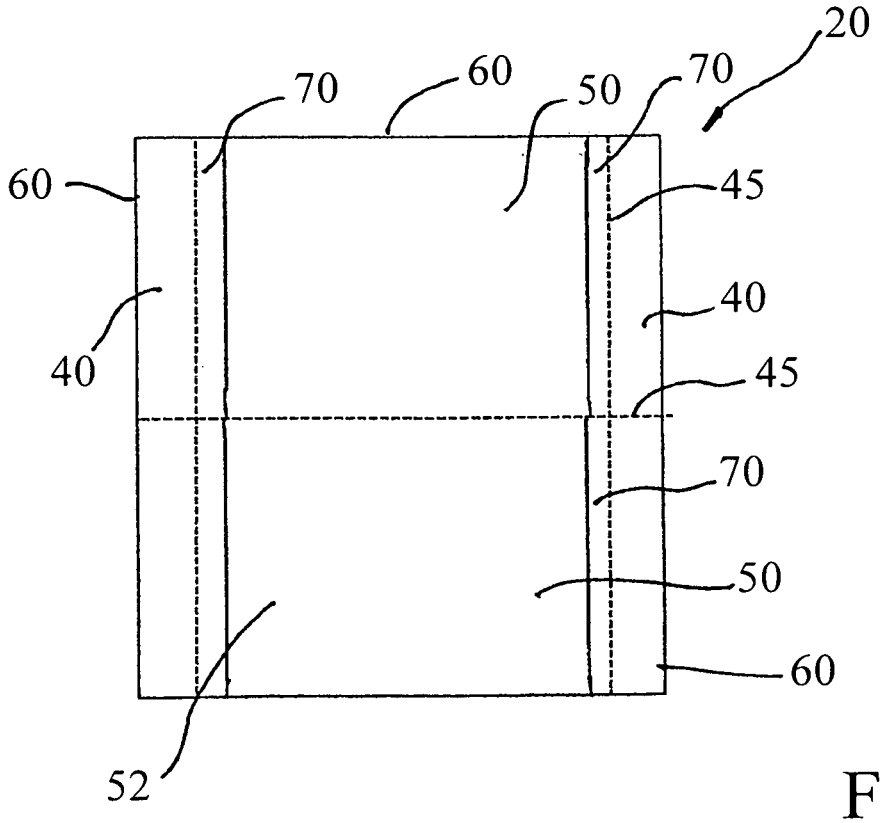
FIG. 4 is a plan view of a back sheet side of the wrapper assembly opposite a face sheet side shown in FIG. 2, according to another preferred embodiment of this invention.

Alternatively, or in addition, two removable portions 70 may overlay wrapper 50 in parallel strips, such as shown in FIG. 4. The two removable portions 70 may be removable to expose corresponding strips of adhesive along wrapper 50. Wrapper assembly 20 may be configured in other manners wherein removable portion 70 overlays the entire wrapper 50 or a portion of wrapper 50 and wherein the adhesive surface coats the entire wrapper 50 or only partially coats wrapper 50.

According to one preferred embodiment of this invention, one or more lines of weakness 45 may extend across wrapper assembly 20 to define two or more wrappers 50 within wrapper assembly 20, such as shown in FIGS. 2 and 3.

A corresponding method of customizing wrapper 50 for a suitable product 50 according to this invention includes the step of feeding wrapper assembly 20 into a printer. Printable surface 52 is suitably printed with customized information on wrapper assembly 20, specifically on wrapper 50.

Figure 5:
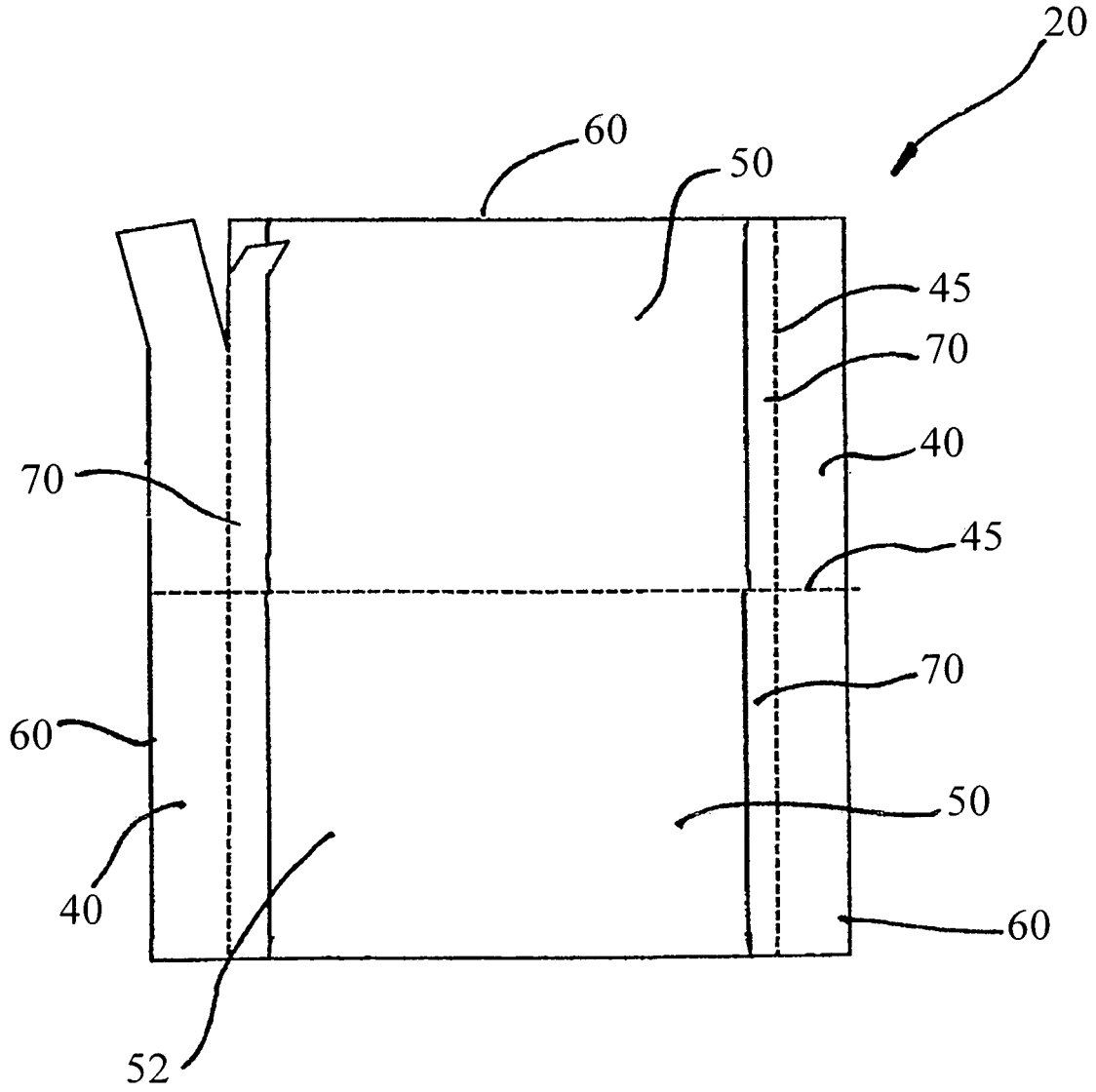
FIG. 5 is another view of a back sheet side of the wrapper assembly shown in FIG. 4.

Following removal from the printer, a pair of removable edges 40 are preferably detached from wrapper assembly 20, as partially shown in FIG. 5. Wrapper assembly 20 may then be subdivided into multiple wrappers 50 along one or more lines of weakness 45.

Removable portion 70 of back sheet 60 is then removed from wrapper assembly 20, as partially shown in FIG. 5. Removable portion 70 thereby exposes an adhesive surface along at least a portion of wrapper 50 for instance, along at least one edge of wrapper 50 or around a perimeter of wrapper 50. Product 15 may then be wrapped within wrapper 50 which is adhered either to itself and/or product 15 along the adhesive surface to cover a front and back of product 15.

To decorate wrapper 50 according to one preferred embodiment of this invention, wrapper assembly 20 is routed through a suitable printer. Information downloaded from an internet website or saved on a computer database for example, is printed on at least one printable surface 52 of face sheet 30. For example, in one preferred embodiment of this invention, a first set of information, such as a corporate logo, is printed on printable surface 52 of wrapper 50. In one preferred embodiment of this invention, a database containing or having a plurality of downloadable images is accessible from a personal computer or work station. At least one of the downloadable images can be selected to download. After the image is downloaded, the image is printed on wrapper 50. As used in the specification and in the claims, the term "information" refers to any suitable or desirable electronic image or design, such as a digital photograph, picture, drawing, pattern, text and/or symbol.

While in the foregoing specification this invention has been described in relation to certain preferred embodiments thereof, and many details have been set forth for purpose of illustration, it will become apparent to those skilled in the art that the invention is susceptible to additional embodiments and that certain of the details described herein can be varied considerably without departing from the basic principles of the invention. Therefore, to particularly point out and distinctly claim the subject matter regarded as the invention, the following claims conclude the specification.

What is claimed is:

1. A method of customizing a wrapper for a candy bar as a gift or favor for an event or occasion, comprising the steps of:

obtaining a candy bar wrapped in an original identifiable packaging;

obtaining a customizable wrapper assembly including a face sheet removably adhered to a back sheet, the face sheet including a wrapper label with a printable surface and sized to cover a front and back of the candy bar;

customizing the wrapper label by feeding the wrapper assembly into a printer, and printing a custom graphic on the printable surface of the wrapper label;

separating the wrapper label including the custom graphic from the wrapper assembly, wherein the wrapper label includes an adhesive material coating at least a portion of the wrapper label;

wrapping the wrapper label around the front and the back of the original identifiable packaging of the candy bar; and adhering the adhesive material of the wrapper label at the back of the candy bar, to cover a front and the back of the original identifiable packaging of the candy bar with the wrapper label.

2. The method of claim 1, wherein the face sheet is coated by the adhesive coating and the back sheet is disposed over the face sheet and the adhesive coating.

3. The method of claim 2, further comprising removing a removable edge from the wrapper assembly prior to the wrapping the wrapper label, the removable edge defined by a tearable line of weakness extending through the face sheet and the back sheet.

4. The method of claim 2, further comprising removing a removable portion of the back sheet to expose the adhesive coating.

5. The method of claim 4, wherein the removable portion extends along an edge of the wrapper label.

6. The method of claim 4, wherein the removable portion extends around a perimeter of the wrapper label.

7. The method of claim 1, wherein the wrapper label is sized to extend around a central portion of the candy bar and leaving end portions of the original identifiable packaging of the candy bar exposed.

8. The method of claim 1, wherein the wrapper assembly has a pair of removable edges, each removable edge defined by a tearable line of weakness extending through the face sheet and the back sheet; the printable surface extends between the removable edges, the printable surface being sized to wrap around and over the candy bar on both a candy bar front side and a candy bar back side; and a removable portion defined by a tearable line of separation extending through only the back sheet, the removable portion at least partially overlaying the face sheet and removable to expose an adhesive surface along the printable surface.

9. The method of claim 1, wherein the printable surface is opposite the adhesive material, and further comprising adhering the wrapper label to at least one of the back of the original identifiable packaging or to the printable surface of the wrapper label at the back of the candy bar.

10. The method of claim 1, further comprising adhering a first portion of the adhesive material of the wrapper label to the front of the original identifiable packaging of the candy bar and a second portion of the adhesive material of the wrapper label to the back of the original identifiable packaging of the candy bar, to cover a front and back of the original identifiable packaging with the wrapper label.

11. A method of customizing a wrapper for a candy bar as a gift or favor for an event or occasion, comprising the steps of:

purchasing a candy bar wrapped in an original identifiable packaging;

purchasing a customizable wrapper assembly including a face sheet removably adhered to a back sheet, the face sheet including a wrapper label with a printable surface and sized to cover a front and back of the candy bar;

customizing the wrapper label for a gift, event, occasion, season, or recipient, by feeding the wrapper assembly into a consumer printer, and printing a custom graphic on the printable surface of the wrapper label;

separating the wrapper label including the custom graphic from the wrapper assembly, wherein the wrapper label includes an adhesive material coating at least a portion of the wrapper label;

wrapping the wrapper label around the front and the back of the original identifiable packaging of the candy bar;

adhering the adhesive material of the wrapper label at the back of the candy bar, to form a wrapper candy bar by covering a front and the back of the original identifiable packaging of the candy bar with the wrapper label; and giving the wrapped candy bar as a giveaway at an event.

12. The method of claim 11, further comprising removing a removable edge from the wrapper assembly prior to the wrapping the wrapper label, the removable edge defined by a tearable line of weakness extending through the face sheet and the back sheet.

13. The method of claim 11, wherein the wrapper label is sized to extend around a central portion of the candy bar and leaving end portions of the original identifiable packaging of the candy bar exposed.

14. The method of claim 11, wherein the wrapper assembly has a pair of removable edges, each removable edge defined by a tearable line of weakness extending through the face sheet and the back sheet; the printable surface extends between the removable edges, the printable surface being sized to wrap around and over the candy bar on both a candy bar front side and a candy bar back side; and a removable portion defined by a tearable line of separation extending through only the back sheet, the removable portion at least partially overlaying the face sheet and removable to expose an adhesive surface along the printable surface.

15. The method of claim 14, wherein the wrapper label is correspondingly sized to the original identifiable packaging of the candy bar.

16. A method of customizing a wrapper for a candy bar as a gift or favor for an event or occasion, comprising the steps of:

purchasing a candy bar wrapped in an original identifiable packaging;

purchasing a customizable wrapper assembly including a face sheet with a printable surface and removably adhered to a back sheet, the face sheet including a wrapper label sized to cover a front and back of the candy bar;

feeding the wrapper assembly into a printer;

printing a custom graphic on a printable surface of the face sheet of the wrapper assembly and over the wrapper label to form a customized wrapper label;

removing a removable portion of a back sheet from the customized wrapper label to expose an adhesive coating, the removable portion at least partially overlaying the customized wrapper label on the face sheet, to expose the adhesive surface along at least one edge of the wrapper label;

covering the original identifiable packaging of the candy bar by wrapping the original identifiable packaging within the customized wrapper label; and adhering the exposed adhesive to at least one of the printable surface or a back of the original identifiable packaging to cover a front and the back of the candy bar with the customized wrapper label.

17. The method of claim 16, further comprising adhering the exposed adhesive to the candy bar.

18. The method of claim 16, further comprising removing a removable edge from the wrapper assembly prior to the wrapping the customized wrapper label, wherein the removable portion extends along an edge of the wrapper label and the removable edge defined by a tearable line of weakness extending through the face sheet and the back sheet.

19. The method of claim 18, wherein the removable portion extends around a perimeter of the wrapper label.

20. The method of claim 16, wherein the wrapper label is sized to extend around a central portion of the original identifiable packaging of the candy bar with ends of the original identifiable packaging exposed.

* * * * *